United States Patent [19]

Sato et al.

[11] Patent Number: 4,637,310

[45] Date of Patent: Jan. 20, 1987

[54] MESH ROLLER FOR PRINTING PRESS AND METHOD OF FABRICATION

[75] Inventors: Masayonshi Sato, Kawasaki; Noritake Harada, Yokohama, both of Japan

[73] Assignee: Tokyo Kikai Seusakusho Ltd., Tokyo, Japan

[21] Appl. No.: 722,994

[22] Filed: Apr. 15, 1985

Related U.S. Application Data

[63] Continuation of Ser. No. 530,026, Sep. 7, 1983, abandoned.

[30] Foreign Application Priority Data

May 9, 1983 [JP] Japan ..... 58-80579

[51] Int. Cl.[4] ..... B41F 31/26

[52] U.S. Cl. ..... 101/426; 101/348

[58] Field of Search ..... 101/148, 150, 170, 348, 101/350; 148/16, 16.6; 29/132

[56] References Cited

U.S. PATENT DOCUMENTS

| | | | |
|---|---|---|---|
| 1,804,176 | 5/1931 | McQuaid | 148/16.6 |
| 2,310,788 | 2/1943 | Hummelchen | 101/350 |
| 3,144,362 | 8/1964 | Bradd | 148/16.6 |
| 3,377,214 | 4/1968 | Woodbridge | 148/16.6 |
| 4,036,130 | 7/1977 | Giori | 101/150 |
| 4,287,827 | 9/1981 | Warner | 101/148 |

FOREIGN PATENT DOCUMENTS

| | | | |
|---|---|---|---|
| 0056856 | 4/1983 | Japan | 101/348 |

OTHER PUBLICATIONS

Lyman, Metals Handbook, 8th Ed., vol. 2, Heat Treating, Cleaning and Finishing, American Society for Metals, 1964.

*Primary Examiner*—J. Reed Fisher

*Attorney, Agent, or Firm*—Trexler, Bushnell & Wolters, Ltd.

[57] ABSTRACT

In a mesh roller for a lithographic printing press a nitride layer is formed into all of an external surface of the mesh roller including recesses (cells) for metering amount of ink, so that the volume of the recesses is not reduced before subsequent plating. Thereafter, in case that copper is plated on the nitride surface of the recesses, reduction of the volume of the recess in minimized.

2 Claims, 4 Drawing Figures

MESH ROLLER FOR PRINTING PRESS AND METHOD OF FABRICATION

This application is a continuation of application Ser. No. 530,026, filed Sept. 7, 1983, now abandoned.

BACKGROUND OF THE INVENTION

This invention relates to ink supplying rollers in lithographic printing presses, and more particularly to a mesh roller or an Anilox roller which has been developed for use in a flexographic printing press, and is now improved for use in the lithographic printing press.

Heretofore, a large number of ink supplying rollers have been used for supplying ink to a plate cylinder of a lithographic printing press, and therefore there is substantially no possibility of dampening water supplied to the plate cylinder being sent back into the ink supplying source of the lithographic printing press.

On the other hand, it is widely known that the numerous ink supplying rollers in a printing press can be replaced by a mesh roller or Anilox roller as in the case of the flexographic printing press.

However, when it is attempted to use the mesh roller in the lithographic printing press, following difficulties must be eliminated advantageously.

(1) Since many inking rollers have been eliminated, the dampening water supplied to the plate cylinder tends to be conveyed through the remaining inking rollers to the surface of the mesh roller;

(2) Because of the presence of a hydrophilic chrome-plated layer on the surface of the mesh roller, dampening water arriving at the mesh roller tends to disturb the deposition of ink on the mesh roller; and (3) Since the amount of ink deposited on the mesh roller is thus reduced, the density of ink impressed on the printing paper is reduced, and the resultant printed matter is made unclear.

SUMMARY OF THE INVENTION

A primary object of the present invention is to provide a mesh roller adapted for use in a lithographic printing press, wherein all of the above described difficulties are substantially eliminated.

Another object of the invention is to provide a mesh roller to be used in a lithographic printing press, wherein the reduction of the deposited ink on the surface of the mesh roller caused by the dampening water is prevented, and a sufficient amount of ink can be supplied smoothly on the plate cylinder.

According to the present invention, there is provided a mesh roller for a lithographic printing press, the mesh roller being made of steel and provided with a large number of fine recesses engraved on an operative surface of the mesh roller, the improvement comprising a hardened layer formed on a part of the operative surface of the mesh roller, from which an excessive amount of ink is scraped off by a blade member, and a hydrophobic layer having an affinity to the ink formed on internal surfaces of the recesses.

The hardened layer may be a nitride layer having a Vickers' hardness more than 1000, and the hydrophobic layer may be formed by plating copper on the internal surfaces of the recesses.

The invention will be decribed in more detail with reference to the accompanying drawings.

PREFERRED EMBODIMENTS OF THE INVENTION

Figure 1:
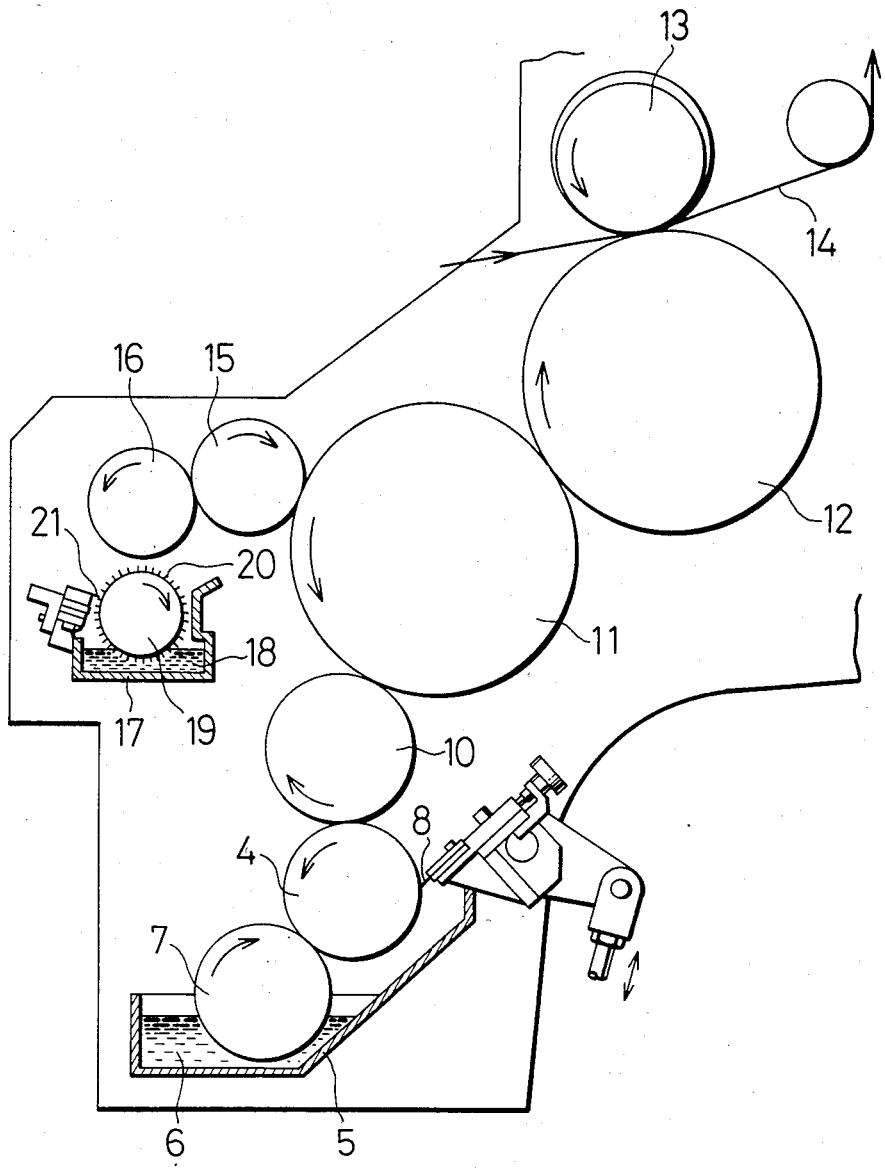
FIG. 1 is a schematic elevational view showing an example of a lithographic printing press utilizing a mesh roller according to the present invention.
Figure 2:
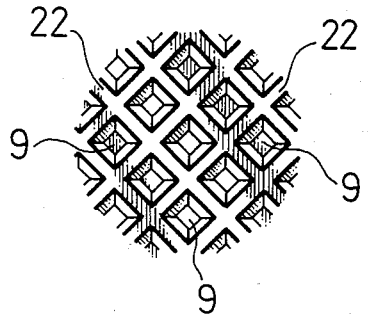
FIG. 2 is an enlarged view showing a part of the recesses formed on the peripheral surface of a mesh roller according to this invention.

FIG. 1 illustrates a lithographic printing press utilizing a mesh roller according to the present invention. In the printing press, a fountain roller 7 picks up ink 6 stored in an ink pan 5 and supplies it to a mesh roller 4. A doctor blade 8 contacting the peripheral surface of the mesh roller 4 in a relation of reverse angle in opposition to the rotating direction of the mesh roller 4 scrapes ink off of the mesh roller 4, so that the ink retained on the roller 4 is restricted to an amount received in a large number of fine recesses 9 formed on the surface of the mesh roller 4 as shown in FIG. 2 in a size of, for instance, 250 meshes. The restricted amount of the ink contained in the recesses 9 is then supplied through a form cylinder 10 to a plate cylinder 11. Numeral 12 designates a blanket cylinder, numeral 13 designates an impression cylinder, and numeral 14 designates printing paper running between the blanket cylinder 12 and the impression cylinder 13.

A water supplying roller 15 is further contacting with the plate cylinder 11. An oscillatory roller 16 contacts the water supply roller 15. Water 18 in a water fountain 17 is carried by a brush 20 provided on the surface of a water-fountain roller 19 successively. A blade 21 bends the bristles of the brush 20, and produces, when it releases the bristles, a repulsive force which projects water contained in the brush 20 toward the oscillatory roller 16.

With the above described construction of the offset printing press, a part of water supplied through the water supply roller 15 to the plate cylinder 11 tends to be transferred through the form cylinder 10 to the mesh roller 4. The peripheral surface of a conventional mesh roller has been chrome plated inclusive of the interior of the recesses for providing a sufficient extent of wear resistivity against the scraping action of the doctor blade. Since chrome is a hydrophilic substance, if such a mesh roller is used in the printing press of the above described construction, the water transferred through the form cylinder to the mesh roller would disturb subsequent deposition of ink on the mesh roller.

The above described difficulty of the conventional construction of the mesh roller can be substantially eliminated according to the present invention.

Figure 3:
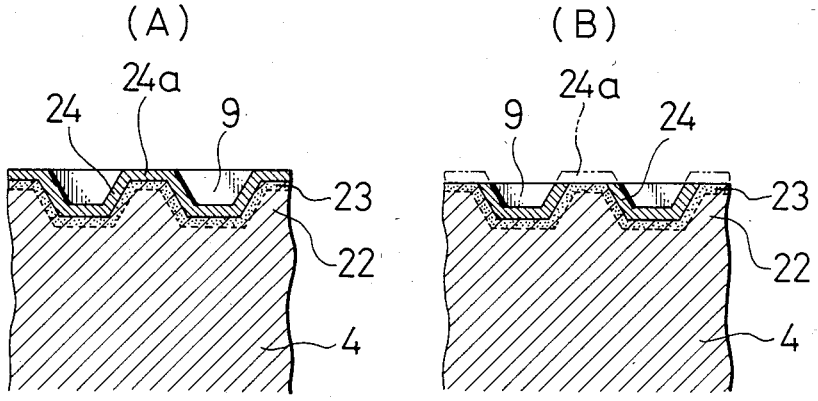
FIGS. 3(A) and 3(B) are cross-sectional views, on an enlarged scale, showing production processes of the mesh roller constituting an embodiment of the present invention.
Figure 4:
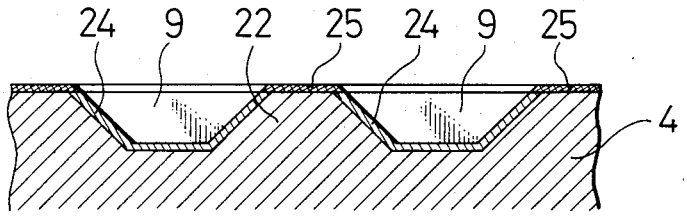

According to the embodiment of the invention, a mesh roller made of steel and constructed as shown in FIG. 2 is firstly subjected to a nitriding process so that a hardened layer 23 of a Vickers' hardness higher than 1000 Hv is formed, as shown in FIG. 3(A), on the entire peripheral surface of the roller inclusive of the mesh-like recesses 9 and projecting portions 22 surrounding the recesses 9. The entire peripheral surface of the roller 4 is thereafter subjected to a copper plating process so that a copper layer 24 is evenly deposited over the entire hardened layer 23. The copper layer 24 is then removed only at the portions 24*a* overlying the projecting portions 22 surrounding the recessed portions 9, so that the hardened layer 23 is exposed outside only at the portions 24*a* as shown in FIG. 3(B). Since the copper layer 24 remaining in the recesses 9 exhibits a hydrophobic property as well as an affinity to the ink, the recesses 9 are always allowed to maintain a sufficient amount of ink to assure clear printing of the printing press. Furthermore, the projecting portions 22 surrounding the recesses 9 are covered by the hardened layer 23 of wear-resistant nature, and therefore the surface of the mesh roller 4 is well protected from the abrasive action of the doctor blade 8.

The advantageous features of the present invention can be summarized as follows.

The mesh roller made of steel and having, on its operative surface, projecting portions 22 liable to be subjected to an abrasive action of the doctor blade 8, is formed with a nitride layer 23 capable of withstanding the abrasion of the doctor blade, while a hydrophobic copper plated layer 24 is formed on the internal surfaces of the recesses 9 for expelling water and reserving a sufficient amount of ink in the recesses. For this reason, the operational life of the mesh roller is elongated, and the quantity of the resultant printed matter can be improved.

Furthermore, by use of the mesh roller of the above described construction, a large number of ink supplying rollers can be eliminated, and the size and the cost of the lithographic printing press can be substantially reduced.

We claim:

1. A process for fabricating a mesh roller for a printing press, wherein the roller includes a large number of recesses formed in the operative external surface thereof, with the internal surfaces of the recesses being defined by a layer of hydrophobic material having an affinity for ink, and the external surface areas of the roller surrounding said recesses being defined by a wear resistant layer, said process comprising the steps of: providing a metal mesh roller member formed from a base nitridable material and having said recesses formed in the outer peripheral surface thereof; nitriding the operative external surface of the roller member to provide the external surface of the roller member with a hardened layer without reducing appreciably the volume of the recesses; providing a coating of hydrophobic material over the entire outer peripheral surface of the roller including the internal surfaces of the recesses formed therein: and removing the hydrophobic material from the external surface areas surrounding the recesses and thus exposing the hardened layer of the base nitridable material of the roller member at said external surface areas, with said hardened layer providing a layer of wear resistant material, with only the internal surfaces of the recesses being coated with said hydrophobic material.

2. A process according to claim 1, wherein the step of providing a coating of hydrophobic material includes the step of plating a layer of copper over the entire outer peripheral surface area of the roller.

* * * * *